United States Patent [19]

Mink

[11] 4,401,219

[45] Aug. 30, 1983

[54] APPARATUS AND METHOD FOR HOLDING JEWELRY

[76] Inventor: Jan B. Mink, 1783 Cable St., San Diego, Calif. 92107

[21] Appl. No.: 297,943

[22] Filed: Aug. 31, 1981

[51] Int. Cl.[3] ..... B65D 75/30; B65B 15/00

[52] U.S. Cl. ..... 206/566; 206/495; 206/466

[58] Field of Search ..... 24/204; 206/466, 538, 206/566, 539, 495, 287, 289, 813

[56] References Cited

U.S. PATENT DOCUMENTS

| | | | |
|---|---|---|---|
| 754,558 | 3/1904 | Greves | 150/34 |
| 1,639,672 | 8/1927 | Schraysshuen | 206/495 |
| 3,207,421 | 9/1965 | Hunger et al. | 206/466 |
| 3,276,601 | 10/1966 | Haggerty | 206/287 |
| 3,525,376 | 8/1970 | Muhlhauser | 24/204 X |
| 4,301,898 | 11/1981 | Plough et al. | 150/34 X |

*Primary Examiner*—William T. Dixson, Jr.
*Assistant Examiner*—Brenda J. Ehrhardt
*Attorney, Agent, or Firm*—Boniard I. Brown

[57] ABSTRACT

A jewelry storage container includes a generally planer flexible web shaped member on which is mounted a plurality of compartments. Each compartment is formed of at least one additional web shaped member. At least one side of each of the compartments is selectively closed by means of a band shaped molded hook and loop fastening apparatus.

6 Claims, 3 Drawing Figures

APPARATUS AND METHOD FOR HOLDING JEWELRY

BACKGROUND OF THE INVENTION

The invention relates to jewelry holding apparatus. A wide variety of apparatus has been known for storing and displaying jewelry. Such devices include jewelry boxes of relatively rigid construction which are particularly adapted for holding jewelry while sitting on a bureau or the like. Other storage apparatus includes jewelry cases such as those typically used in jewelry stores.

It is an object of the invention to provide apparatus which will be particularly suitable to holding jewelry both for display as well as for storage and which will avoid tangling and scratching of jewelry disposed in the apparatus.

It is another object of the invention to provide apparatus which may be compactly rolled and which is thus easy to use while traveling as well as being easy to hide to minimize the danger of theft, in that it fits into small places such as clothing, small handbags and hiding places.

It is another object of the invention to provide apparatus which will be suitable for mounting on a hanger.

Still another object of the invention is to provide apparatus which enables the user to view substantially all the contents of the container.

Yet another object of the invention is to provide apparatus which will easily retain necklaces and other elongated jewelry items in a manner which will prevent them from tangling with or rubbing against other items or other axial portions of the same item as well as to permit the user to better observe each item.

SUMMARY OF THE INVENTION

The foregoing objects and other objects and advantages which shall become apparent from the detailed description of the preferred embodiment are attained in an apparatus which includes a jewelry storage container which has a generally planar flexible web shaped member and a plurality of compartments mounted on the first web shaped member. Each compartment is formed of at least one additional web shaped member. At least one side of each of the compartments is selectively closed by means of a band shaped molded hook and loop fastening apparatus.

In some forms of the invention the apparatus includes a plurality of the compartments. Each compartment may be formed by two additional web shaped members. At least some of the compartments may include a plurality of linear connections, stitched or heat bonded, between the web shaped members to define subcompartments. The apparatus may include a plurality of tying members for securing the apparatus to an associated hanger. The apparatus may also include a loop and snap for securing the apparatus to an associated hanger. The apparatus may include means for securing an associated elongated piece of jewelry in at least one of the compartments which comprises a band shaped molded hook and loop fastening apparatus for joining axially spaced sections of an associated elongated piece of jewelry at axially spaced intervals of the band shaped molded hook and loop fastening apparatus.

The invention also includes the method for securing an elongated piece of jewelry which includes the steps of providing a band shaped molded hook and loop fastening apparatus and securing axially spaced portions of the elongated piece of jewelry at axially spaced points intermediate the molded band shaped hook and loop fastening apparatus.

BRIEF DESCRIPTION OF THE ACCOMPANYING DRAWING

DESCRIPTION OF THE PREFERRED EMBODIMENT

Figure 1:
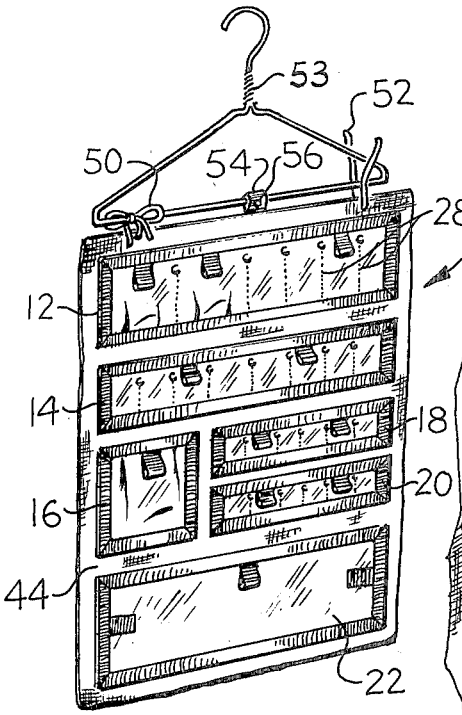
FIG. 1 is a perspective view of the apparatus in accordance with one form of the invention.
Figure 2:
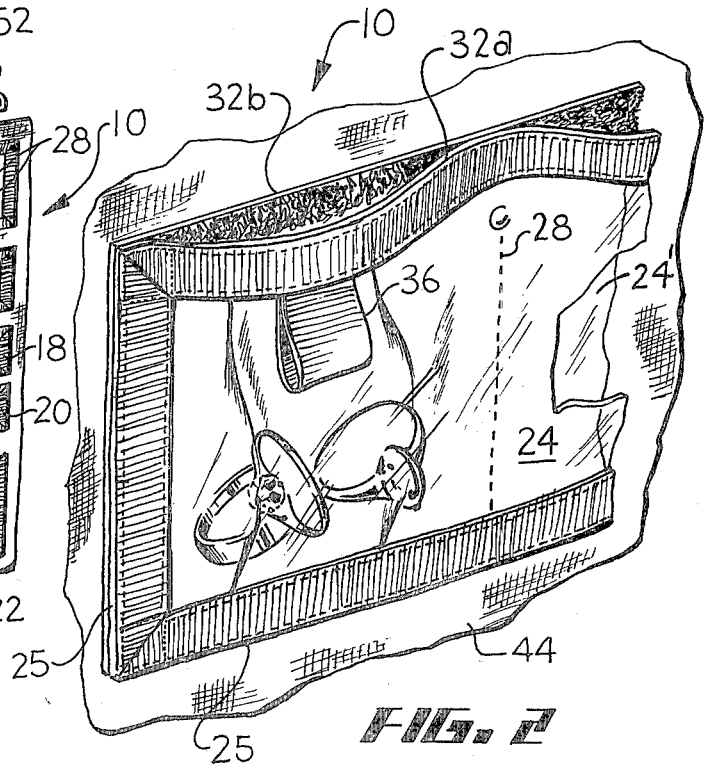
FIG. 2 is an enlarged partial perspective view of a portion of the apparatus illustrated in FIG. 1.
Figure 3:
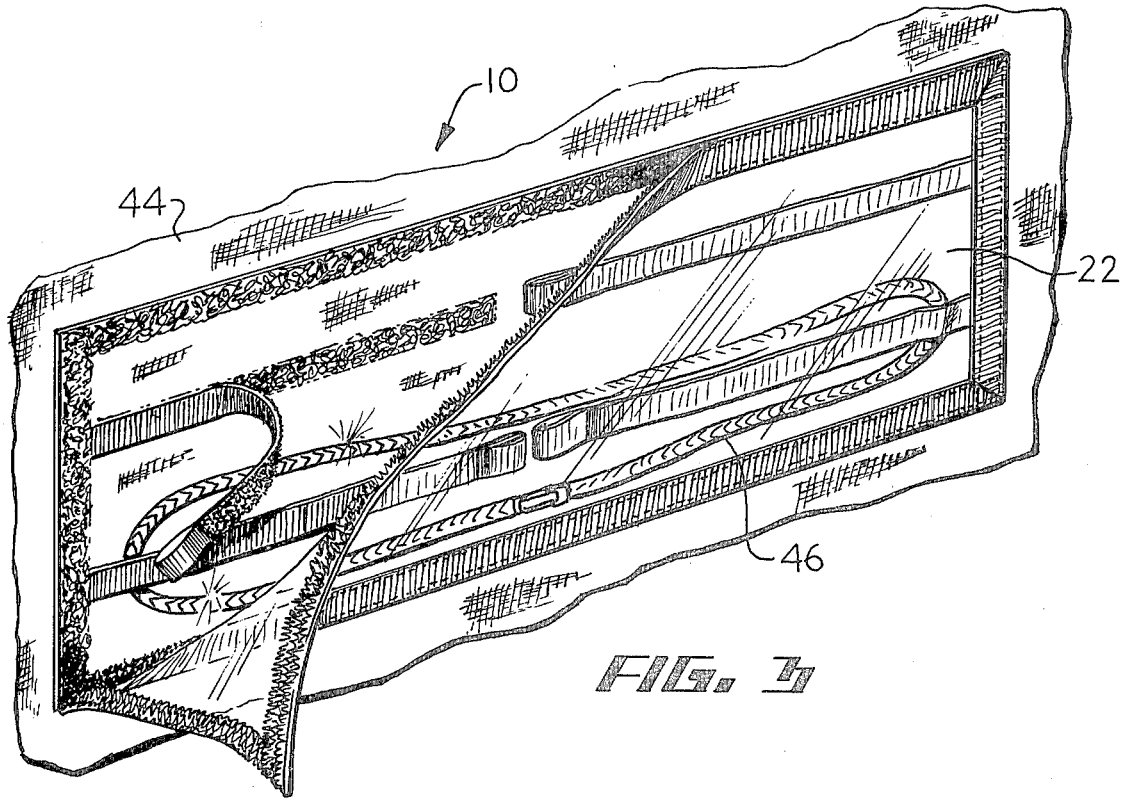
FIG. 3 is another enlarged partial perspective view of another portion of the apparatus illustrated in FIG. 1.

Referring now to FIGS. 1, 2 and 3, there is shown a web shaped jewelry storage apparatus 10 in accordance with one form of the invention. The web shaped jewelry storage apparatus 10 is provided with storage compartments 12, 14, 16, 18, 20 and 22. The storage compartments 12, 14, 18, and 20 are substantially the same except for dimensional differences. Each compartment 12, 14, 18, and 20 is formed by two web shaped members 24, 24' which are substantially similar and are disposed in overlapping relationship. The web members are mounted on quilted fabric material by appropriate means, such as stitching. Disposed along the side and bottom edges is a binding tape 25. These edges may be stitched in place or may be heat bonded together in various forms of the invention. Ordinarily, the material for the web shaped members 24, 24' will be a transparent plastic material which is suitable for heat bonding. At spaced intervals along the axial extent of the storage compartments, defined by the web shaped members, there are disposed heat bonded or stitched interconnections 28 extending along substantially vertical lines. These interconnections 28 serve to define discrete subcompartments in the storage compartment 12. In one form of the invention, the individual compartments 12–22 are defined by one member 24 and a quilted piece of cloth material by sewing or other known fastening means. Disposed along the top edge of the compartment 12 is a band shaped VELCRO fastener having portions **32*a* and 32*b*. The term VELCRO will be understood to refer to the Trademark of Velcro U.S. Inc., 681 Fifth Ave., New York, N.Y. Other alternative molded hook and loop structures will be understood to be also suitable. The use of the molded hook and loop band portions 32*a*, 32*b*, enable the user to positively seal the entire upper edge of the compartment 12 while still enabling easy access to the interior of the individual subcompartments. A tab 36 extends from each of the VELCRO hook bands 32*a* to facilitate the opening of a typical subcompartment in the compartment 12. It will be understood that the compartments 14, 18 and 20 are generally similar to the compartment 12** except for the dimensions thereof.

The compartment 16 is also generally similar to compartment 12 except that no transverse interconnections 28 are provided intermediate the two laminations or web shaped members from which the compartment is formed. It will be understood that in each of the compartments 12, 14, 18 and 20, a single web shaped member may be utilized and may be fastened directly to the quilting material. In such forms of the invention, stitching or other process than heat bonding will be necessary to define the subcompartments. In other forms of the invention, each of the individual compartments 12–22, may be mounted on a larger piece of plastic material which may be heat bonded. In those forms of the invention it will not be necessary to provide two discrete laminations for the compartments 12, 14, 18 and 20, and will absolutely not be necessary for the compartment 16. The choice of single or dual laminations in each of the compartments 12–20, thus will vary in different embodiments of the invention.

Compartment 22, as best seen in FIG. 3, is provided with four molded hook and loop bands 40 about the entire peripheral extent thereof. The compartment 22 may be formed of a single lamination 24 mounted on web shaped quilting material or other material 44. Disposed within the compartment 22, as best seen in FIG. 3, is a plurality of molded hook and loop bands 40. Advantageously, a necklace 46 may be held by the molded hook and loop bands 40 as illustrated in FIG. 3. Even though an axial portion of the molded hook and loop bands 40 may not actually join together because of the interposition of the necklace 46, the necklace will be firmly held in place because the axially spaced portions of the molded hook and loop bands 40 will be firmly engaged and thus the necklace 46 will not be able to move axially with respect to the molded hook and loop bands 40. In the illustrated embodiment, the compartment 22 is provided with four discrete cooperating molded hook and loop bands 40 disposed in generally parallel spaced relationship. It will be understood that other orientations and other numbers of such bands may be advantageously used in the apparatus in accordance with the invention.

The jewelry storage apparatus 10, as will be seen in FIG. 1, may advantageously be provided with tie strings 50, 52 at two axially spaced intervals along the top surface thereof. These tie strings 50, 52 may be easily tied to a hanger 53. In some forms of the invention, a band shaped loop member 54, having a snap fastener 56, extends from the upper edge of the apparatus 10 and further assists in holding the apparatus 10 into an associated hanger 53. The holding action of the loop 54 and snap 56 is in addition to the holding action with the tie string 50, 52, as best illustrated in FIG. 1.

It will thus be seen that the apparatus, in accordance with the invention, facilitates the storage of jewelry in a plurality of discrete compartments to avoid rubbing or scratching or tangling of articles against each other, and which further allows easy rolling of the apparatus 10 into a compact bundle, so that it may be stored in a relatively safe location, and unrolling for quick and convenient access to selected articles.

The invention has been described with reference to its illustrated preferred embodiment. Persons skilled in the art of constructing jewelry holding apparatus may, upon exposure to the teachings herein, conceive variations in the mechanical development of the components therein. Such variations are deemed to be encompassed by the disclosure, the invention being delimited only by the appended claims.

The inventor claims:

1. A jewelry storage container which comprises:

a generally planar flexible first web shaped member;

a plurality of compartments defined on said first web shaped member, each compartment being formed from at least one additional web shaped member, at least one side of each of said compartments being selectively closed by means of a band shaped molded hook and loop fastening apparatus;

at least some of said compartments including a plurality of linear attachment connections between said web shaped members to define subcompartments;

said apparatus including a plurality of tying members for securing said apparatus to an associated hanger in addition to a loop and snap for securing said apparatus to an associated hanger; and means for securing an associated elongated piece of jewelry in at least one of said compartments which comprises band shaped molded hook and loop fastening apparatus for joining axially spaced sections of an associated elongated piece of jewelry at axially spaced intervals of said band shaped molded hook and loop fastening apparatus.

2. A jewelry storage container which comprises:

a generally planar flexible first web shaped member;

a plurality of compartments defined on said first web shaped member, each compartment being formed from at least one additional web shaped member, at least one side of each of said compartments being selectively closed by means of a band shaped molded hook and loop fastening apparatus;

at least some of said compartments including a plurality of linear attachment connections between said web shaped members to define subcompartments;

means for securing said apparatus to an associated hanger; and means for securing an associated elongated piece of jewelry in at least one of said compartments which comprises band shaped molded hook and loop fastening apparatus for joining axially spaced sections of an associated elongated piece of jewelry at axially spaced intervals of said band shaped molded hook and loop fastening apparatus.

3. A jewelry storage container apparatus which comprises:

a generally planar flexible first web shaped member;

a plurality of compartments defined on said first web shaped member, each compartment being formed from at least one additional web shaped member, at least one side of each of said compartments being selectively closed by means of a band shaped molded hook and loop fastening apparatus;

means for securing said apparatus to an associated hanger; and means for securing an associated elongated piece of jewelry in at least one of said compartments which comprises band shaped molded hook and loop fastening apparatus for joining axially spaced sections of an associated elongated piece of jewelry at axially spaced intervals of said band shaped molded hook and loop fastening apparatus.

4. The apparatus as described in claim 3, wherein:

at least some of said compartments include a plurality of linear attachment connections between said web shaped members to define subcompartments and said apparatus includes a plurality of tying members for securing said apparatus to an associated hanger.

5. The apparatus as described in claim 4, wherein:

said apparatus further includes a loop and snap for securing said apparatus to an associated hanger.

6. The method for securing an elongated piece of jewelry which comprises:

providing a web shaped element;

providing a band shaped molded hook member and a loop fastening member;

fixing one of the members to the element; and securing axially spaced portions of the elongated piece of jewelry at axially spaced points intermediate the molded hook member and the loop fastening member.

* * * * *